US005201817A

United States Patent [19]

Hailey

[11] Patent Number: 5,201,817

[45] Date of Patent: Apr. 13, 1993

[54] DOWNHOLE CUTTING TOOL

[76] Inventor: Charles D. Hailey, 11628 Burning Oaks, Oklahoma City, Okla. 73150

[21] Appl. No.: 815,327

[22] Filed: Dec. 27, 1991

[51] Int. Cl.[5] ..... E21B 10/32; E21B 29/06

[52] U.S. Cl. ..... 175/269; 166/55.8; 175/267

[58] Field of Search ..... 166/55.8, 298, 55.7; 175/267, 269, 268

[56] References Cited

U.S. PATENT DOCUMENTS

| | | | |
|---|---|---|---|
| 392,592 | 11/1888 | Douglas | 166/55.8 X |
| 1,494,274 | 5/1924 | Morgan . | |
| 1,805,515 | 5/1931 | Denney | 166/55.8 |
| 2,284,170 | 5/1942 | Santiago | 255/76 |
| 2,353,284 | 7/1944 | Barrett | 166/55.8 |
| 2,481,637 | 9/1949 | Yancey | 166/55.8 X |
| 2,735,485 | 2/1956 | Metcalf, Jr. | 166/55.8 |
| 2,822,150 | 2/1958 | Muse et al. | 255/76 |
| 3,050,122 | 8/1962 | Huitt et al. | 166/55.8 |
| 3,087,546 | 4/1963 | Woolley | 166/55.8 |
| 4,431,065 | 2/1984 | Andrews | 175/269 |
| 4,809,793 | 3/1989 | Hailey | 175/265 |
| 5,018,580 | 5/1991 | Skipper | 166/298 |
| 5,090,480 | 2/1992 | Pittard et al. | 175/267 X |

OTHER PUBLICATIONS

SlimDril, Inc. brochure reprinted from 36th (1984–85) Composite Catalog (four pages).

Kat Tool Inc. brochure on Thru Tubing Tools (Clean-out, Cable Cutters, Tubing Cutters)—four pages.

*Primary Examiner*—Hoang C. Dang

*Attorney, Agent, or Firm*—Dougherty, Hessin, Beavers & Gilbert

[57] ABSTRACT

A downhole cutting tool for use down along a tubing string consisting of an elongate body member having central cavity and transverse slotway and receiving drilling fluid axially therethrough. An expandable double blade is pivotally housed in the slotway while fluid actuated pistons above and below are effective to expand the blades outboard on each side and to brace the blades in operative position as the body member is rotated and the blades abrade or cut the adjacent material.

14 Claims, 2 Drawing Sheets

DOWNHOLE CUTTING TOOL

BACKGROUND OF THE INVENTION

1. Field of the Invention

This invention relates generally to downhole cutting tools and clean-out methods and more particularly, but not by way of limitation, it relates to tubular goods clean-out tools of a type having upwards or downwards traversing capability with an expandable cutting tool that removes debris or other downhole material that was heretofore difficult to work.

2. Description of the Prior Art

The prior art has seen a number of different downhole tools for use in such as cutting casing, underreaming, notching along a formation, enlarging the borehole and various other operations as performed by larger diameter tools. However, the present invention is concerned with cleaning and cutting tools of smaller diameter. Casing fixed downhole in a wellbore sometimes needs to be cleaned of cement, sand, shale, mud and other types of deposits as it is encountered in the oil and gas industry. This requires a type of tool that can be lowered through a relatively narrow diameter tubing string to clean first the tubing string and subsequently the area immediately below or around the tubing string, i.e., the relatively wider diameter casing. "Thru tubing" clean-out tools as used for clean-out, cable cutting, tubing cutting and the like, have been developed and sold by Kat Tool, Inc. of New Iberia, La. This clean-out tool functions to remove scale and earth fill from the well bore below a packer without the necessity for drilling out the packer. Such clean-out tools may be run on small tubular goods as pump pressure is utilized to extend expansible knife blades as rotation and pumping will circulate out any debris.

U.S. Pat. No. 2,822,150 discloses a borehole enlargement tool, a rotary expandable drill bit, which extends blades laterally to function as rotary cutters. Outward extension of the cutter bars is accomplished by longitudinal movement of a plunger that is engaged to turn cutter blades about a rotary axis.

U.S. Pat. No. 2,284,170 provides a teaching where lateral cutters are actuated to an outward operating position in response to fluid pressure present internally in the drill string. A cutter actuating plunger is moved downward under fluid pump pressure thereby to actuate the cutter blades outboard from the longitudinal axis of the tool. Actually, the tool is intended for scraping of the borehole wall.

U.S. Pat. No. 3,050,122 discloses a formation notching apparatus having expansible cutter blades that are actuated to the outboard of a rotating cutting tool thereby to notch the borehole wall. Such notching is utilized for formation indication. This particular tool includes a casing cutting capability as well as the notching apparatus and each is operated in similar manner in response to downhole fluid pressure.

More to the point is the present inventor's prior U.S. Pat. No. 4,809,793 which expressly teaches a tubing tool for utilization in cleaning out deposits immediately below the tubing string and next to the well casing. This device uses an over and under alignment of expansible stabilizer blades over expansible cutter blades that are actuated by the drilling fluid pressure to spread their respective blades outward within the confines of the tubing and/or casing. This patent utilizes pressure driven pistons located above the respective stabilizer and cutter blades, and effective under pressure to move downward and force rotation of the blades outboard to their expanded position.

SUMMARY OF THE INVENTION

The present invention relates to improvements in downhole cutting tools wherein cutter blade actuation is effected with both upwards and downwards force within the cutting tool thereby to reinforce the operative tool for upward cutting and grinding movement within tubing, well casing or the like. The tool consists of an elongated, cylindrical body member that is adapted for subassembly usage with various forms of stabilizer, rotational motor, etc. The body member includes a variable radius axial bore and a generally central, transverse slot extending therethrough and intersecting a central cavity which houses the cutter blades in position for upper and lower piston activation whereupon the blades are extended outboard through the opposite sides of the slot. A first pressure responsive actuator is formed in the axial bore above the cutter blades and this is in the form of an actuating piston responsive to the drilling fluid pressure to exert force downwards. A plurality of fluid passageways are provided that lead to the axial bore below the cutter blades for actuation of a second pressure actuated piston that exerts force upwards and is spring loaded to assume the downward position when actuating pressure is relieved. Drilling fluid pressure then flows outward at the bottom into an adjoining drilling head, e.g., a milling head or similar type of cutter that is threadedly connected to the cutter tool.

Therefore, it is an object of the present invention to provide a downhole cutting tool that is more resistant to forces acting against upward cutting surfaces.

It is also an object of the present invention to provide an upward cutting tool for operation in tubing, casing or other substructure.

It is still further an object of the present invention to provide a downhole cutting tool that operates in response to applied fluid pressure while also providing surface pulse indication of operational attitude.

Finally, it is an object of the present invention to provide a cutting and clean-out tool that can perform cutting operations while being moved either up or down thereby to enable more efficient clean-out of certain down-hole joints and tubing combinations.

Other objects and advantages of the invention will be evident from the following detailed description when read in conjunction with the accompanying drawings which illustrate the invention.

DETAILED DESCRIPTION OF THE INVENTION

Figure 1:
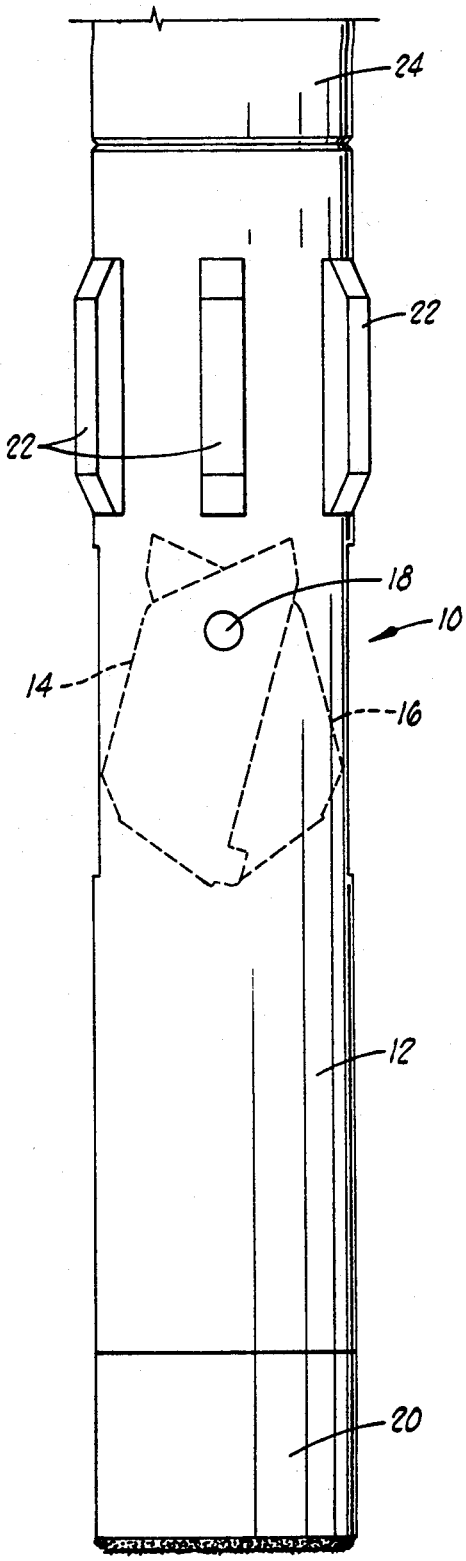
FIG. 1 is a side view in elevation of a cutter tool constructed in accordance with the present invention.

Referring to FIG. 1, the cutting tool 10 consists of an elongated, cylindrical body member 12 which houses the cutter blades 14, 16 and all actuating components along an axial bore formed therein. Cutting blades 14 and 16 are pivotally retained by means of a pivot pin 18 that is threadedly engaged in body member 12. The bottom end of cutting tool 10 is threadedly affixed to a suitable drilling head or milling head 20 as pressurized drilling fluid circulates down through the entire mechanism.

A plurality of equi-spaced stabilizer blocks 22 are secured as by welding around the upper end circumference of cutter tool 10. There may be any number from 3 to 8 equi-spaced stabilizer blocks 22 utilized, this depending upon the radius of annular space with which to be contended. The cutter tool 10 is next joined by threaded engagement to a subassembly such as a rotational motor sub 24, a selected motor suitable for small diameter drilling systems. Such motors are available from SlimDril, Inc. of Houston, Tex. The small diameter SLIMDRIL TM motors are capable of generating bit speeds from 740–1230 RPM for 1 11/16 outside diameter and in a range of 400–800 RPM at an outside diameter of 3¾.

Figure 2:
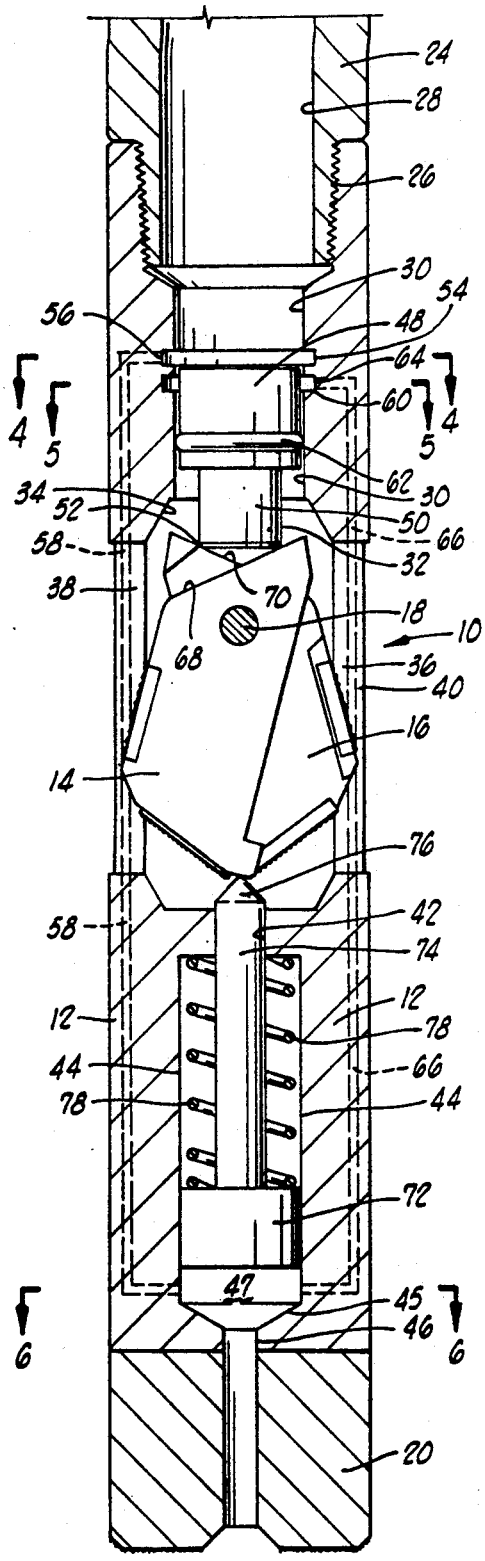
FIG. 2 is a view in vertical section of the cutter tool of FIG. 1 when in the de-actuated condition.
Figure 3:
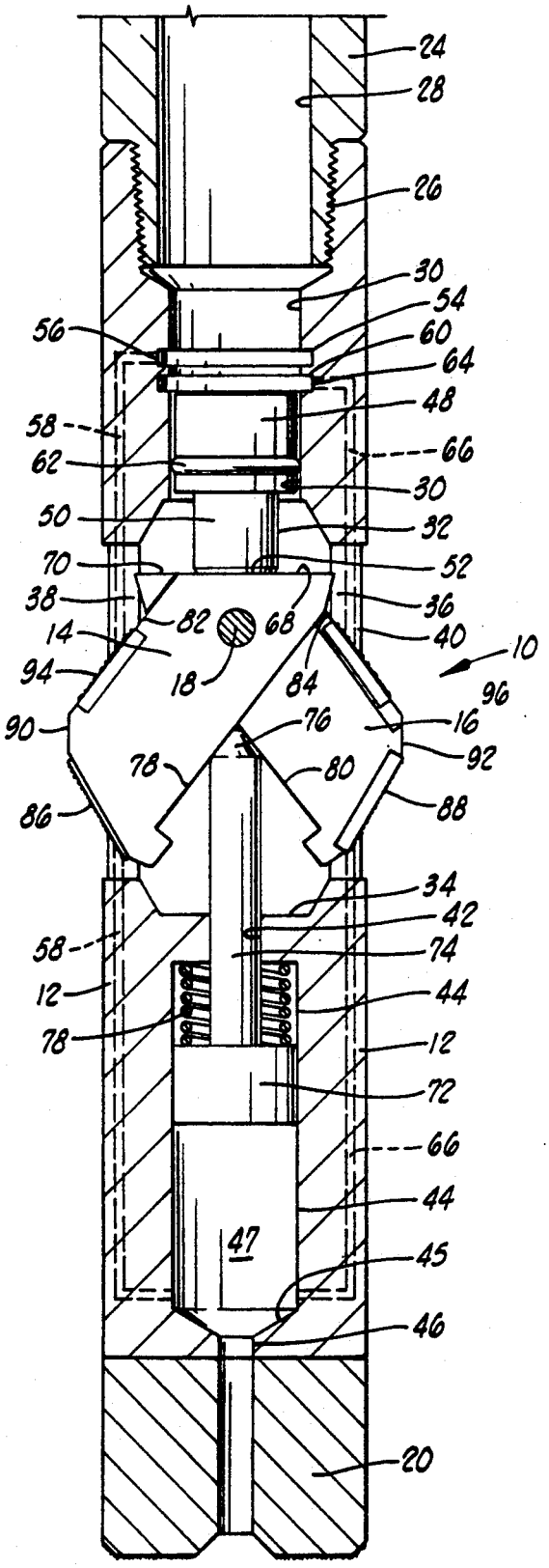
FIG. 3 is a side view in vertical section of the cutter tool in the actuated or operational condition.

Referring to FIGS. 2 and 3, the body member 12 is secured on motor drive coupling 24 by means of threads 26. Threads 26 are standard drill string type continually engaged in response to right turning of the string. The drive coupling 24 includes a central bore 28 for delivering drilling fluid under pressure to the cutting tool 10. The cutting tool 10 includes an axial bore 30 and a counterbore 32 which leads into a central cavity 34 that receives the pivotally affixed cutter blades 14 and 16. A transverse slot 36 is formed by opposite side, vertically elongated slot ways 38 and 40 as the slot intersects with central cavity 34. Cavity 34 is formed in one dimension to accommodate the double thickness of cutter blades 14 and 16 as retained by pivot pin 18, and in the other dimension to have sufficient width to enable cutter blades 14 and 16 to be expanded completely outboard through slot ways 38 and 40 into operational configuration as shown in FIG. 3.

The lower end of body member 12 is formed with a first counterbore 42 in communication with cavity 34 and expanding outward into a bore 44 that extends downward and is funneled into drilling fluid passage 46 which is in communication with the drilling fluid channels of milling head 20. Volume 47 comprises a cylinder housing the piston assembly, as will be described. The drilling fluid into milling head 20 functions in conventional manner to provide rotation of any moving parts while also serving to carry chips and debris away and upward through the annular flow. Various types of cutting head may be utilized in place of milling head 20 since primary rotation is provided by the SLIMDRIL TM rotation as coupled via drive coupling 24 and the washout function will be present as required.

Figure 4:
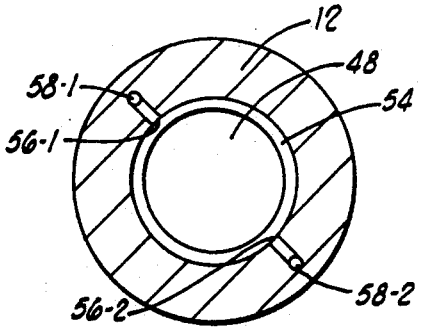
FIG. 4 is a section taken along lines 4—4 of FIG. 2.

A first actuating assembly consists of an upper piston 48 having a rod end 50 disposed for reciprocation within bore 30 and counterbore 32. The rod end 50 includes a circular foot end 52 which functions to engage the cutter blades 14, 16 during actuation, as will be further described. An upper annular groove 54 is formed around bore 30 in communication with a plurality of ports 56 leading to by-pass passageways 58 which extend around the cutter mechanism. Referring to FIG. 4, there are shown 2 opposed ports 56-1 and 56-2 leading from annular groove 54 to the by-pass passageways 58-1 and 58-2. However, it should be understood that a greater number of ports may be utilized as necessitated by design considerations.

As illustrated in FIG. 2, the inoperative position, the upper surface of piston 48 rests at the lower wall of annular groove 54 so that there is normally open fluid flow from the bore 28 through annular groove 54 and ports 56 to by-pass passageways 58 and on to the lower outlet fluid passage 46.

Figure 5:
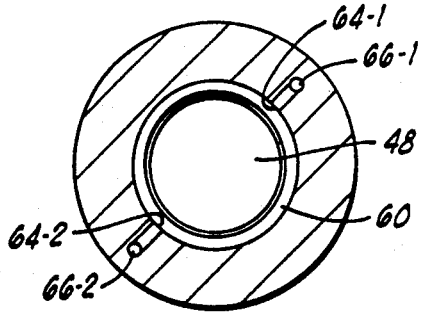
FIG. 5 is a line taken along lines 5—5 of FIG. 2.
Figure 6:
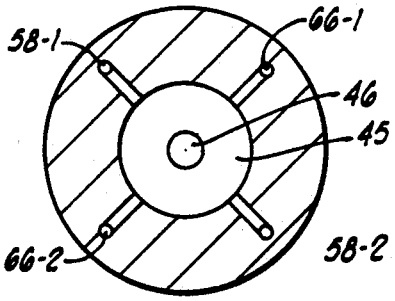
FIG. 6 is a section taken along lines 6—6 of FIG. 2.

A second annular groove 60 is formed around axial bore 30 at a position where it is normally blocked by the sidewalls of piston 48 with further sealing by a seated elastomer O-ring 62. Referring also to FIG. 5, the annular channel 60 also communicates via ports 64-1 and 64-2 with by-pass passageways 66-1 and 66-2. In this case, two ports are shown, one being lost by section in FIG. 2, but it should be understood that the number of ports are a design consideration. By noting FIG. 3, it is also apparent that sufficient fluid pressure at bore 28 forces piston 48 downward and beneath the position of second annular groove 60 thereby allowing pressurized fluid flow through the respective port 64 and by-pass passageways 66. Also, the downward movement of piston 48 places rod end 50 and foot pad 52 in activating contact with respective angle ends 68 and 70 of cutter blades 14 and 16 thereby to expand the blades outboard through respective slot ways 38 and 40 and into operational position.

Simultaneous with actuation of upper piston 48, the fluid pressure build up in lower bore volume 47 will cause actuation of a lower piston 72 sliding within cylinder bore 44 to extend an elongated rod end 74 having an angled pad end 76 against the bias of a coil spring 78. The elongated rod end 74 is then moved up through narrower bore 42 such that pad end 76 engages the lower edges 79 and 80 of respective cutter blades 14 and 16 thereby to force the cutter blades open as well as to continually brace the cutter blades against any opposing force as the cutting tool 10 is moved upwards during operation.

The particular pair of cutter blades 14 and 16 make up what is termed one type of banana blade combination. The respective cutter blades 14 and 16 have lower edges 78 and 80 as well as angle edges 68 and 70. They are further made up of respective upper edges 82 and 84 .as well as quarter edges 86 and 88 and respective outboard elbow surfaces 90 and 92. The outboard areas of the blades 14 and 16, i.e., the edges, are hardened by any of several hardening processes to enable most effective cutting. Thus, the quarter edges 86 and 88 may include an insert of natural diamonds fused into a matrix and bonded into the blade edges 86 and 88. Similar hardening structure may be utilized at upper edge shoulders 94 and 96 and a special flush-mounted diamond pad is utilized in inlay at each of elbow surfaces 90 and 92. Alternatives to the diamond inlay cutting configurations are tungsten carbide surfaces such as KUTRITE® inserts and/or thermally stable polycrystalline diamond materials within suitable matrices.

In operation, the cutter tool 10 may be employed variously with selected pairs of cutter blades as well as in various tandem combinations of subassemblies. Thus, there are various types of heavy duty cutter and reamer blade that are best employed with the reinforcing bottom piston and wedge head. And, the cutter tool 10 may be employed with additional stabilizing or clean-out tools such as the subassembly clean-out tools taught in U.S. Pat. No. 4,809,793. This patent teaches the downhole enhanced diameter clean-out tool which is also used in combination with a conveyancing means including coil tubing motor apparatus such as the SLIM-DRIL TM type of rotation subassembly.

The cutter tool 10 is capable of being introduced down through a tubing string to a wellbore area that requires clean-up of the tubing or casing condition. For example, such as the cutter tool 10 is particularly desirable for cleaning mill out or seal bore extensions that are placed below seal and packer assemblies in a well casing. As shown in FIGS. 2 and 3, the combination with milling head 20 enables the cutter tool 10 to be entered down through a sector of cement or other well debris whereupon the cutter blades 14 and 16 are subsequently actuated outboard into the cutting condition so that the cutter tool 10 is withdrawn upward to ream out all debris within the tubing inner walls.

A normal threshold pressure of down flowing fluid within bore 28 will pass through annular groove 54 and downward by-pass passageways 58-1 and 58-2 to maintain operational pressure at milling head 20 so that drill cutting proceeds. In this status, the blades 14 and 16 are withdrawn inward in the attitude generally shown in FIG. 2, and the bias of compression spring 78 maintains the piston 72 withdrawn under force of the by-passing fluid pressure. An increase in fluid pressure from the surface operating position will then depress upper piston 48 and its rod end 32 so that foot pad 52 contacts the respective angle edges 68 and 70 of blades 14 and 16 to begin their outward spread through respective slot way apertures 38 and 40. After a delay, the upper surface of piston 48 will have cleared the lower or second annular channel 60 so that fluid pressure is seen through the by-pass passageways 66-1 and 66-2 (see FIG. 5). When this occurs the fluid pressure at volume 47 is increased over a threshold amount which forces piston 72 against compression spring 78 to move elongated piston 74 and wedge head 76 upward within the crotch between lower edges 79, 80 of respective blades 14 and 16 thereby to force the blades outboard and to maintain a continual pressure thereon. The movement of piston 48 to clear lower channel 60 reflects an immediate pressure response at the surface operating station, and this response is developed as an indicator pulse that allows the operator to determine when the cutter blades 14 and 16 were deployed outboard. This is a variable magnitude signal that enables the operator to maintain a continual indication of the deployment and retraction of cutter blades 14, 16 during operation of cutter tool 10.

As shown in FIG. 3, cutter tool 10 when fully deployed will have cutter blades 14 and 16 expanded fully outboard as braced by wedge head 76 of piston rod end 74. Upward cutting of the tool takes place with the shoulder hardening elements 94 and 96 while the lower quarter cutting will occur in response to hardening elements 86 and 88. Elbow pads 90 and 92 are reinforced by flush-mounted diamond so that they will ride on the tubular goods inner wall without cutting or grinding.

The entire operation is responsive to application of sufficient fluid pressure from the surface operating position. Thus, when the operating pressure is reduced to a next lower level, the residual pressure within volume 47 will decrease allowing the piston 72 to retract downward within bore 44 under urging by compression spring 78. The pressure reduction will also be seen above piston 48 thereby to allow the piston to move upward sealing off annular channel 60 and moving piston rod end 50 upward so that foot pad 52 no longer forces against angle edges 52 and 70 of respective blades 14 and 16. With this, the blades 14 and 16 retract within cavity 34 and the entire cutter portion of cutter tool 10 is in the quiescent condition although sufficient pressure is still present through by-pass passages 58-1 and 58-2 to maintain milling head 20 in an operative condition.

The foregoing discloses a novel type of downhole cutter subassembly of a type that includes a reinforcing actuation mechanism that enables more efficient grinding, cutting and removal of certain forms of tubing or casing obstruction. The device may be deployed with various types of subassembly in combination and this includes stabilizers, alternative forms of cutting or cleaning tool, as well as tubing or casing cutter implements. One form of blade combination (not shown) is particularly suitable for use with the reinforcing cutter tool as a casing cutter and section mill implement and this is described in a co-pending application, U.S. application Ser. No. 07/816,296 entitled "IMPROVEMENTS IN CUTTER BLADES FOR ROTARY TUBING TOOLS".

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A downhole cutting tool, comprising:

a body member including a slot defined laterally therethrough and further including a longitudinal cavity having upper and lower ends defined therein in communication with said slot;

first and second cutting members each having angled and lower edges and being pivotally mounted in opposed orientation in said slot;

first piston means disposed in said cavity adjacent and proximate to the angled edges of said first and second cutting members;

second piston means disposed in said cavity adjacent and proximate to the lower edges of said first and second cutting members; and fluid control means responsive to an increase in fluid pressure in said cavity to force said first and second piston means into said first and second cutting members thereby to spread the first and second cutting members outward through the slot on respective opposite sides of the body member into cutting attitude.

2. A tool as defined in claim which is further characterized to include:

spring means normally urging said second piston means away from said lower edges of the first and second cutting members.

3. A tool as defined in claim 1 wherein said fluid control means comprises:

first porting means for conducting fluid from said cavity upper end adjacent the first piston means to said cavity lower end adjacent the second piston means; and second porting means actuated open by a pressure increase on said first piston means for conducting fluid from said cavity upper end to said cavity lower end adjacent the second piston means thereby to move the second piston means upward.

4. A tool as defined in claim 3 which is further characterized to include:

a milling head having an axial fluid port and being threadedly received on the body member with the fluid port in communication with the cavity lower end.

5. A tool as set forth in claim 3 wherein:

each of said first and second porting means comprise plural passageways formed within said body member.

6. A tool as set forth in claim 1 wherein said first and second cutting members comprise:

a first generally rectangular, elongated blade having a pivot hole near an angled end, said blade having an upper edge, a lower edge and a quarter edge formed with a hardening substance;

a second generally rectangular, elongated blade having a pivot hole near an angled end, said blade having an upper edge, a lower edge and a quarter edge formed with a hardening substance; and a pivot pin for pivotally securing respective pivot holes of the first and second blades in reversed relationship so that upper edges are defined outboard on each side of the cutting assembly.

7. A tool as set forth in claim 6 wherein:

said hardening substance is tungsten carbide.

8. A tool as set forth in claim 6 wherein:

said hardening substance is an inlay of diamond matrix.

9. A tool as set forth in claim 6 wherein:

said hardening substance is thermally stable polycrystalline diamond.

10. A tool as set forth in claim 1 wherein said body member further comprises:

an elongated cylindrical formation having an axial bore formed at the upper end for receiving the first piston means, and communication with an enlarged central cavity intersecting said laterally defined slot, and further communication to a second axial bore formed at the lower end for receiving the second piston means.

11. A downhole cutting tool, comprising:

an elongate body member having upper and lower ends and including a slot defined laterally therethrough;

a cutting assembly pivotally retained within said body member slot;

first piston means disposed above said cutting assembly and actuatable to force said cutting assembly radially outward into operative position; and second piston means disposed below said cutting assembly and actuatable simultaneously with said first piston means actuation to reinforce said cutting assembly radially outward into operative position.

12. A cutting tool as set forth in claim 11 which is further characterized to include:

spring means normally urging said second piston means away from said cutting assembly.

13. A cutting tool as set forth in claim 11 which is further characterized to include:

at least one porting means for conducting fluid between said first piston means and said second piston means.

14. A cutting tool as set forth in claim 11 which further includes:

a milling head having an axial fluid port secured to the lower end of the body member.

* * * * *

UNITED STATES PATENT AND TRADEMARK OFFICE

CERTIFICATE OF CORRECTION

PATENT NO. : 5,201,817

DATED : April 13, 1993

INVENTOR(S) : Charles D. Hailey

It is certified that error appears in the above-indentified patent and that said Letters Patent is hereby corrected as shown below:

Column 6, line 51 (line 1 of claim 2), after "claim" insert the numberal --1--.

Signed and Sealed this

Thirtieth Day of November, 1993

Bruce Lehman

*Attest:*

BRUCE LEHMAN

*Attesting Officer*

*Commissioner of Patents and Trademarks*